United States Patent [19]

Saur

[11] Patent Number: 4,537,158

[45] Date of Patent: Aug. 27, 1985

[54] APPARATUS FOR COOLING AN INTERNAL COMBUSTION ENGINE

[75] Inventor: Roland Saur, Stuttgart, Fed. Rep. of Germany

[73] Assignee: Behr-Thomson Degnstoffregler GmbH, Fed. Rep. of Germany

[21] Appl. No.: 616,493

[22] Filed: Jun. 1, 1984

[30] Foreign Application Priority Data

Jun. 4, 1983 [DE] Fed. Rep. of Germany ..... 3320338

[51] Int. Cl.[3] ..... F01P 7/16; F01P 3/20; G05D 7/06

[52] U.S. Cl. ..... 123/41.1; 123/41.49; 123/41.12; 236/34.5

[58] Field of Search ..... 123/41.08, 41.09, 41.1, 123/41.49, 41.12; 236/34.5, 34, 51

[56] References Cited

U.S. PATENT DOCUMENTS

| | | | |
|---|---|---|---|
| 2,377,028 | 5/1945 | Nicholas. | |
| 2,401,646 | 6/1946 | Johnson. | |
| 2,833,478 | 5/1958 | Middleton. | |
| 2,881,616 | 4/1959 | Clifford et al. | |
| 3,313,483 | 4/1967 | Nallinger. | |
| 3,851,629 | 12/1974 | Mayr et al. | 123/41.08 |
| 3,907,199 | 9/1975 | Kreger | 236/34.5 |
| 3,952,946 | 4/1976 | Braukmann | 236/34 |
| 3,964,444 | 6/1976 | Hemmann et al. | 123/41.49 |
| 4,062,329 | 12/1977 | Rio | 123/41.49 |
| 4,175,696 | 11/1979 | Braukmann. | |
| 4,164,322 | 8/1979 | Wong et al. | |
| 4,175,697 | 11/1979 | Dreibelbis. | |
| 4,288,031 | 9/1981 | Hass | 123/41.1 |
| 4,325,508 | 4/1982 | Kunz. | |
| 4,347,973 | 9/1982 | Jackson. | |
| 4,378,760 | 4/1983 | Barge | 123/41.49 |
| 4,426,960 | 1/1984 | Hart | 123/41.49 |
| 4,475,485 | 10/1984 | Sakakibara et al. | 123/41.12 |

FOREIGN PATENT DOCUMENTS

| | | | |
|---|---|---|---|
| 695730 | 8/1953 | Great Britain. | |
| 861937 | 1/1953 | Germany. | |
| 7910213 | 4/1977 | France | 123/41.12 |

*Primary Examiner*—Craig R. Feinberg
*Assistant Examiner*—David A. Okonsky
*Attorney, Agent, or Firm*—Barnes & Thornburg

[57] ABSTRACT

Apparatus for cooling an internal combustion engine of a motor vehicle is provided having a thermostatic valve for controlling the coolant flow and having at least one fan associated with the radiator. The fan (or fans) can be operated in several output stages and the thermostatic valve can be adjusted to at least two different opening temperatures. When the thermostatic valve is adjusted to a higher opening temperature, operation of the fan in the output stage associated with a lower coolant temperature is blocked.

6 Claims, 3 Drawing Figures

APPARATUS FOR COOLING AN INTERNAL COMBUSTION ENGINE

BACKGROUND AND SUMMARY OF THE INVENTION

This invention relates to apparatus for cooling an internal combustion engine, especially in a motor vehicle, having a thermostatic valve for controlling the coolant flow from and to the combustion engine via a direct return or via a radiator, and having at least one fan associated with the radiator. This fan (or fans) can, as a function of at least one lower and one higher coolant temperature, be operated in at least two output stages (i.e., at least two fan operating modes having lower and higher respective output levels are provided).

In apparatus of this type, the thermostatic valve affects the temperature of the coolant and, thus, the temperature of the combustion engine by determining the temperature level at which it unblocks the connection to the radiator. In order to reduce the fuel consumption of the internal combustion engine, it is provided that the fan associated with the radiator is switched on only when it is required, i.e., when the temperature of the coolant and, thus, the temperature of the engine exceed a certain value. In this case, it is customary to operate the fan at several power levels or output stages, with the lowest output stages of the fan being assigned to a lower coolant temperature. Thus, when the temperature of the coolant increases, the fan will then be operated at a higher output stage. An object of this invention is to provide apparatus of the above-described type which allows the operating temperature of the internal combustion engine to be changed or adjusted, while preventing unnecessary consumption of output power by the fan.

This objective is achieved by providing a thermostatic valve which can be adjusted to at least two different opening temperatures, and by providing switching means for blocking the operation of the fan in the output stage associated with the lower coolant temperature when the thermostatic valve is adjusted to open at the higher coolant temperature.

The arrangement makes possible the adjustment of the engine temperature by means of different opening temperatures of the thermostatic valve, especially for optimizing the operation of the internal combustion engine. For example, it may be provided that in winter, as a function of the low outside temperatures, the thermostatic valve is adjusted in such a way that the internal combustion engine operates at a higher temperature. To avoid partially offsetting the effect of the increase in temperature, and also to avoid an increase in power consumption, it is provided in this case that the fan associated with the radiator does not operate at the lower coolant temperature at which it would normally start when the internal combustion engine is operated at the lower temperature level.

In an advantageous embodiment of the invention, an electric control element is provided for adjusting the thermostatic valve and a fan is electrically driven in at least the lower output stage which corresponds to the lower coolant temperature. A relay, which is controlled by the same signal transmitter which controls the electric control element, provides a switching contact in the electric feed line for the lower output stage.

In an especially advantageous embodiment of the invention, the thermostatic valve comprises a thermostatic working element having a housing to which is attached a valve disk. The valve disk cooperates with a valve seat to form a valve in the flow line leading to the radiator. The thermostatic valve also has a working piston extendable from the working element when the element is heated. The free end of the piston is adjacent to a support surface, the position of which can be adjusted in such a way that the distance from a support point on the surface to the piston end can be adjusted. With this arrangement, it is possible to use a thermostatic valve of conventional construction without necessitating modification of its structure, with the possible exception of a lengthening of the working piston.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
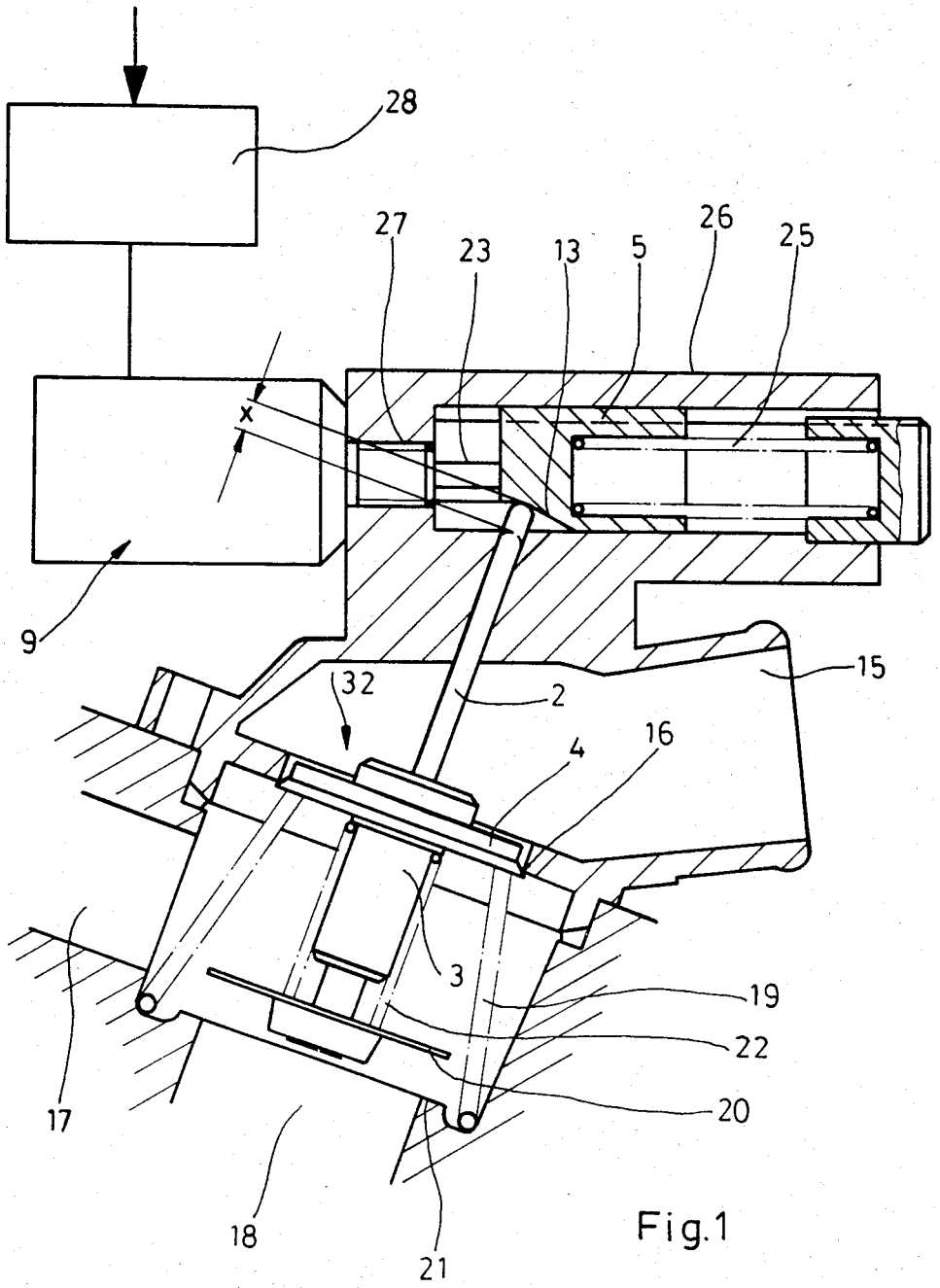
FIG. 1 shows a sectional view of a thermostatic valve having an adjustable opening temperature.

FIG. 1 shows a thermostatic valve 32 which controls the coolant flow of an internal combustion engine from a flow inlet 17 to a direct return 18 and/or to a connecting piece 15, which, in a manner that is not shown in detail, is connected to a heat exchanger (i.e. a radiator). The radiator is, in turn, connected to an inlet of the internal combustion engine. Thermostatic valve 32 has a thermostatic working element 3 consisting of a housing containing an elastic material and of a working piston 2 which is movable extendable from the housing when the valve is heated. Depending on the temperature, the elastic material of the working element changes its volume so that the working piston 2 is extended out from, or upon cooling, drawn back into, the housing. The housing of the working element is firmly connected to a valve disk 4 by, for example, a press-fit, a flanged connection, or a similar method. Valve disk 4 has a conical edge which cooperates with a valve seat 16 formed on connecting piece 15. As can be seen in FIG. 1, valve seat 16 is formed as a right angle. The valve that is formed by valve disk 4 and valve seat 16 closes and opens the line of flow between flow inlet 17 and connecting piece 15 leading to the radiator. Valve disk 4 is held in the closed position (the position shown in FIG. 1) by a conically coiled pressure spring 19. On a slideway of the housing of working element 3, another valve disk 20 is arranged which cooperates with a valve seat 21 formed on direct return 18. Valve disk 20 is acted upon by a pressure spring 22 that is arranged on and guided by housing working element 3.

In the initial position shown in FIG. 1, coolant flows in via flow inlet 17 between the two valves 4, 16 and 20, 21 and flows out via direct return 18 to the internal combustion engine. When the coolant reaches a high enough temperature, the elastic material of working element 3 expands, causing working piston 2 to be driven out of the housing of working element 3 until the end of piston 2 contacts support 5. Upon further expansion of the elastic material, resulting in further extension of working piston 2, the housing of working element 3, valve disk 4 and valve disk 20 are shifted. Thus, the valve formed by valve disk 4 and valve seat 16 is opened, followed by a closing of the valve formed by valve disk 20 and valve seat 21. Support 5 for working piston 2 is located in a projection 26 of connecting piece 15, and can be adjusted in such a way that the opening temperature of thermostatic valve 32 can be changed. Support 5 can be moved or slid in a direction which is generally transverse to the axis of working piston 2. Support 5 is guided in projection 26 so that it can be slid against the force of a pressure spring 25. The adjustment or shifting of support 5 is accomplished by means of an adjusting element 9 which is attached to projection 26 by threaded member 27. Adjusting element 9 has a piston 23 which moves support 5 against the force of spring 25. Support 5 is provided with a diagonal support surface 13 which has a slope extending toward the moving direction of working piston 2. Support 5 can be shifted in such a way that the support points formed at the intersection of the longitudinal axis of working piston 2 and support surface 13 may be located at any position along the axis for the distance marked X in FIG. 1. In the position shown, support 5 is adjusted in such a way that, when the elastic material expands, working piston 2 must first travel the entire distance X before contacting diagonal support surface 13 of support 5. When piston 2 extends further, it opens the valve 4, 16 and closes the valve 20, 21. In the case of this adjustment, the internal combustion engine is operated at a higher temperature. When support 5 is shifted into the other extreme position, the valve 4, 16 opens earlier, i.e., at a lower temperature, while the valve 20, 21 is correspondingly closed at a lower temperature. The internal combustion engine will then operate at a lower temperature level.

Adjusting element 9 is preferably an electric adjusting element actuated by a signal transmitter 28 representing the command variable. This signal transmitter can respond to different conditions, such as the outside temperature, the exhaust-gas temperature, the speed or torque of the engine, the vacuum in the suction pipe or intake manifold, a pressure difference in a vacuum box or the oil temperature. In this way, performance of the internal combustion engine can be optimized by adjustment of the operating temperature of the internal combustion engine.

Figure 2:
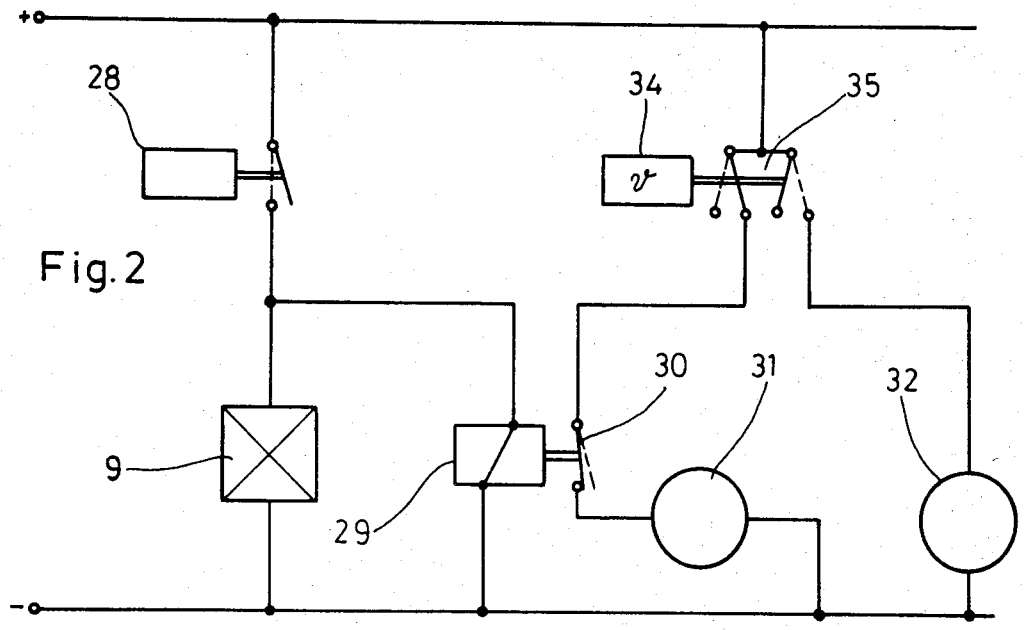
FIG. 2 shows a circuit diagram which provides for electrical control of the adjustment of the thermostatic valve and for actuation of an electrically driven fan for the radiator in the switching position which corresponds to the lower coolant temperature level.
Figure 3:
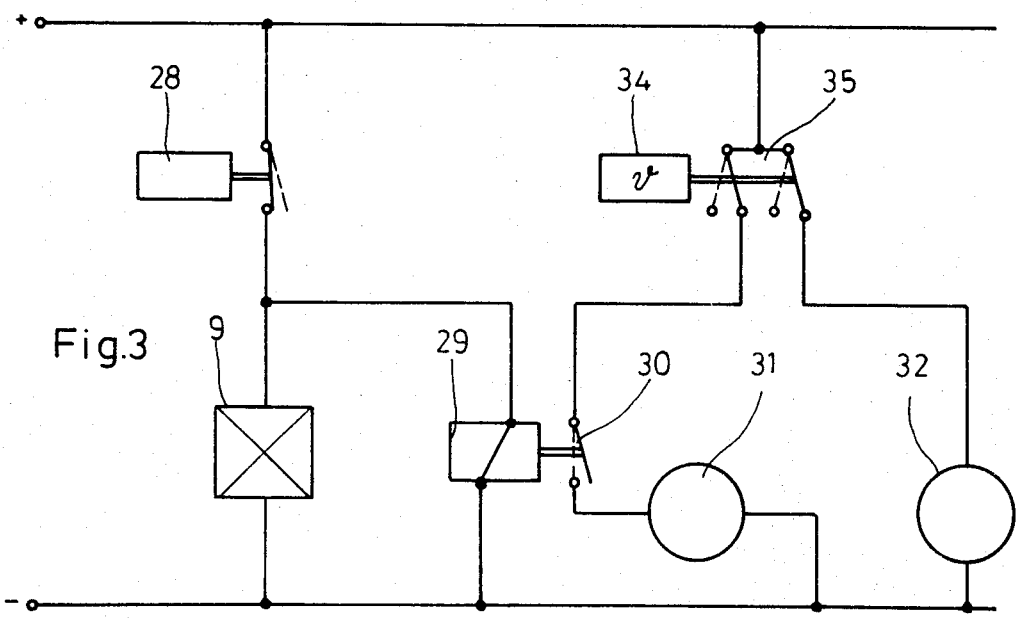
FIG. 3 shows the circuit diagram of FIG. 2 in a switching position which corresponds to an increased operating temperature level of the internal combustion engine.

Referring now to FIGS. 2 and 3, there is shown an electrical circuit diagram which schematically includes adjusting element 9, signal transmittor 28 and a preferred arrangement for the control of the fan. As noted, at least one fan is associated with the radiator in a manner which is well known to those skilled in the art and which is not shown in detail here. The fan is preferably driven by an electric motor. To reduce the amount of power required to operate the fan, the fan is operated only when the coolant temperature (and, thus, the engine temperature) exceeds a certain temperature limit. To accomplish this, a temperature sensing device 34 is provided. Sensing device 34 may be located in an area of the engine or radiator where it will be surrounded by the flow of coolant. Temperature sensing device 34 switches a step switch 35 which, for example, at a predetermined temperature of 95° C. switches on the second output stage 32. As used here, the term output stage represents an operating level of the fan, or fans, provided to draw air through the radiator to facilitate heat exchange. The quantity of air provided by the fan for this purpose varies from one operating level, or output stage, to another. Although several output stages may be provided, only two output stages (31 and 32) are illustrated in FIGS. 2 and 3 for purposes of this description. Multiple output stages may be achieved by providing multiple drive units for a single fan, by placing resistors in series with the fan motor, or by providing a fan motor with multiple sets of windings. In the latter case, two windings can be connected and switched as illustrated by output stages 31 and 32 in FIGS. 2 and 3. It is also possible to provide two fans, of which, when output stage 31, corresponding to the lower coolant temperature, is selected, only one fan is switched on and, when output stage 32 is selected, both fans are switched on. In addition, a continuous control of the fan drive is also possible.

When the internal combustion engine is to be operated at an increase engine temperature, signal transmitter 28, responding to its command variable, energizes adjusting element 9 of the thermostatic valve 32 so as to increase the opening temperature of the thermostatic valve. A relay 29 is energized simultaneously with adjusting element 9 to actuate a switching contact 30 located in the line which supplies power to the first output stage 31. When switching contact 30 opens, first output stage 31 cannot be energized via temperature sensing device 34 and step switch 35. This means that, when an increased engine operating temperature is desired, this temperature cannot be reduced by operation of the fan at the output level associated with first output stage 31. Blocking the operation of the fan is output stage 31, in the case of this desired increase in operating temperature, assures a further reduction in output power consumption.

Blocking the operation of the fan in first output stage 31 during operation of the engine at an increased temperature may also be used in the case of a fan having continuous speed adjustment provided as a function of the coolant temperature. In this case, the switching must be selected in such a way that the first output stage is switched off at a fan speed which corresponds to a lower coolant temperature. In principle, the same system is also applicable when the fan is connected to a shaft of the internal combustion engine by a hydraulic clutch. In this case, the filling volume of the hydraulic friction clutch must then be controlled correspondingly.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for cooling an internal combustion engine, comprising:

a thermostatic valve having a closed position for directing a coolant flow to the engine via a direct return, and having an open position for directing the coolant flow to the engine via a radiator when said coolant flow reaches a temperature in excess of an opening temperature of the thermostatic valve;

means for adjusting said opening temperature of the thermostatic valve to at least two different temperature operating levels;

at least one fan associated with said radiator and being operable in at least a lower and a higher output stage in correspondence with at least a lower and a higher engine coolant temperature, respectively; and switching means, responsive to said means for adjusting the opening temperature of the thermostatic valve, have been for blocking the operation of the lower output stage of said fan when the opening temperature of the thermostatic valve is adjusted to a higher of said at least two different temperature operating levels.

2. Apparatus according to claim 1, wherein said means for adjusting said opening temperature comprises an electric control element.

3. Apparatus according to claim 1, wherein said thermostatic valve comprises:

a thermostatic working element;

a valve disk attached to a housing of said working element, said valve disk cooperating with a valve seat to form a valve controlling flow of coolant to the radiator;

a working piston movably extendable from said working element housing when said working element is heated; and support means for providing a support point for the working piston, said support means being adjustable to vary the distance from the support point to said working element housing.

4. Apparatus according to claim 1, wherein said at least one fan is electrically driven in at least a lower output stage corresponding with said lower coolant temperature.

5. Apparatus according to claim 4, wherein said switching means includes a relay operable to interrupt an electric feed line to said lower output stage in response to a signal from a signal transmitter.

6. Apparatus according to claim 5, wherein said means for adjusting said opening temperature comprises an electric control element operable in response to a signal from said signal transmitter.

* * * * *

UNITED STATES PATENT AND TRADEMARK OFFICE

CERTIFICATE OF CORRECTION

PATENT NO. : 4,537,158

DATED : August 27, 1985

INVENTOR(S) : Roland Saur

It is certified that error appears in the above-identified patent and that said Letters Patent is hereby corrected as shown below:

Title page:

In [73] change "Degnstoffregler" to -- Dehnstoffregler--.

Signed and Sealed this

*Fifteenth* Day of *July 1986*

[SEAL]

*Attest:*

DONALD J. QUIGG

*Attesting Officer*

*Commissioner of Patents and Trademarks*